US005116673A

United States Patent [19]

Vodiunig et al.

[11] Patent Number: 5,116,673

[45] Date of Patent: May 26, 1992

[54] HIGH-TEMPERATURE RESISTANT STACKING SUPPORT

[75] Inventors: Robert Vodiunig, Leoben; Gerhard Reiter, Schörfling; Klaus Weinrotter, Vöcklabruck, all of Austria

[73] Assignee: Lenzing AG, Lenzing, Austria

[21] Appl. No.: 498,284

[22] Filed: Mar. 23, 1990

[30] Foreign Application Priority Data

Apr. 6, 1989 [AT] Austria ..... 814/89

[51] Int. Cl.[5] ..... B32B 15/08; B32B 17/10

[52] U.S. Cl. ..... 428/332; 156/321; 156/322; 428/435; 428/457; 428/458

[58] Field of Search ..... 428/457, 475.8, 901, 428/332, 458, 435; 156/321, 322

[56] References Cited

U.S. PATENT DOCUMENTS 4,751,146 6/1988 Maeda et al. ..... 428/475.8

4,943,334 7/1990 Medney et al. ..... 428/901 X

FOREIGN PATENT DOCUMENTS

WO89/08161 2/1989 World Int. Prop. O. .

*Primary Examiner*—Thomas J. Herbert, Jr.

*Attorney, Agent, or Firm*—Kenyon & Kenyon

[57] ABSTRACT

A high-temperature resistant stacking support is composed of a, preferably self-supporting, core which at least partially is surrounded by a high-temperature resistant fiber composite made of polyimide fibers of the general formula (I)

wherein n is an integer larger than 1 and A represents a four-valent aromatic group.

The stacking support can be produced by shrinking a polyimide fiber nonwoven consisting of polyimide fibers of the general formula (I) onto the core under heat exposure.

These stacking supports are particularly useful for stacking heated aluminum sections.

9 Claims, 1 Drawing Sheet

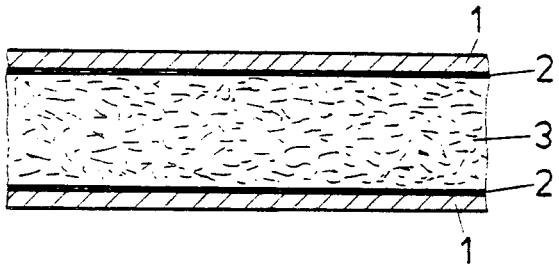
1
2
3
2
1

HIGH-TEMPERATURE RESISTANT STACKING SUPPORT

The invention relates to a high-temperature resistant stacking support as it is used as a spacer in the stacking of hot sections in the metal processing industry.

Cardboard or wood strips, which are commonly used as stacking supports, offer an extremely limited field of application due to their low thermostability. For instance, they cannot be used for the stacking of continuously cast metal sections that are subjected to heat treatments up to 200° C. in a furnace for several hours. Even at lower temperatures, cardboard strips have the disadvantage that low-molecular weight substances are emitted from the cardboard and deposit on the sections and, thus, impairing the quality of the product.

Stacking supports of fiberglass reinforced epoxy resins do not have these disadvantages. Yet, the surfaces of the metal sections get scratched on the faces of the support by the hard resin matrix and by glass fibers standing out of the matrix, so that high-temperature resistant textile sheet-like structures, such as fabrics or felts or para- or meta-aramide fibers, must be adhered for protection. However, adhered textiles have relatively low strengths limiting their mechanical wear resistance considerably. Add to this that the matrix strength gradually decreases at temperatures above 200° C.

It is the object of the invention to eliminate the disadvantages pointed out above and to provide a high-temperature resistant stacking support that may be used, in particular, at temperatures of above 200° C. and does not affect the surfaces of the stacked goods.

BRIEF DESCRIPTION OF THE DRAWING

The FIGURE is a schematic illustration of a stacking support of the present invention.

In accordance with the invention, this high-temperature resistant stacking support is composed of a, preferably self-supporting, core which at least partially is surrounded by a high-temperature resistant fiber composite made of polyimide fibers of the general formula

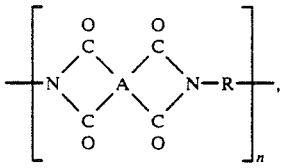

(I)

wherein n is an integer larger than 1 and A represents a four-valent aromatic group selected from

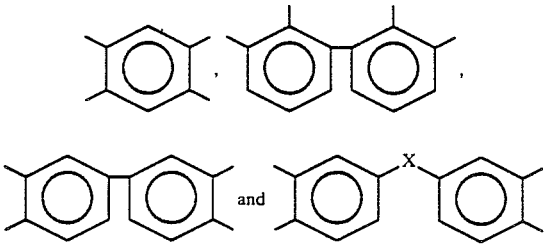

in which X is selected from the group consisting of CO, $CH_2$, O, S and $CF_2$, and R represents at least one of the following divalent aromatic groups selected from

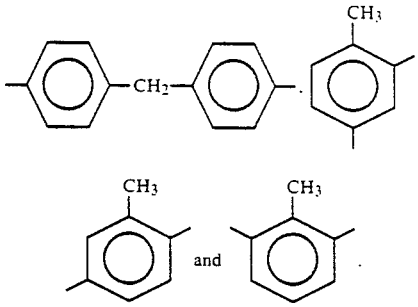

Polyimide fibers of this type may be produced and processed by the process described in PCT application WO89/08161. They can be processed to manipulatable nonwovens that densify to a fiber composite under heat exposure and, if desired, under pressure at temperatures in the glass transition range between 280° and 350° C.

A substantial advantage of nonwovens made of polyimide fibers over nonwovens made of para- and meta-aramide fibers consists in that, due to the exposure to heat, the thickness, the density and, thus, the strength of the fiber composite may be adjusted within wide ranges.

Preferably, the fiber composite exhibits the following properties in combination:

- a thickness of 0.50 to 8.0 mm, preferably of 1.0 to 3.0 mm;
- a density of 0.3 to 1.1 g/cm$^3$;
- a tensile strength of at least 15 N/mm$^2$.

Stacking supports of this type are very resistant to mechanical stresses and are reusable several times.

An advantageous embodiment of the stacking support according to the invention comprises a core of a fiber glass composite, in particular of a glass-reinforced synthetic resin, or of a metallic material, the modulus of elasticity of the core preferably ranging between 10,000 N/mm$^2$ and 40,000 N/mm$^2$. Stacking supports having moduli of elasticity larger than 10,000 N/mm$^2$ are very well suited for use in automated stacking operations.

The stacking support according to the invention is particularly suited for stacking heated aluminum sections, in particular during a tempering treatment of aluminum sections. Temperatures up to 280° C. are typically employed.

The stacking support according to the invention is capable of being produced in that the thermally densified polyimide fiber composite is pressed or adhered to the, preferably self-supporting, core. A further manufacturing process, which is particularly simple, is characterized in that a polyimide fiber nonwoven consisting of polyimide fibers of the general formula

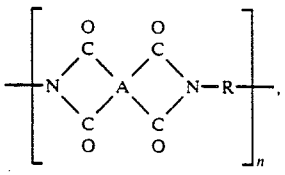

(I)

wherein n, A and R have the meanings indicated above, is shrunk onto the core under heat exposure.

The invention will be explained in more detail by the following examples:

EXAMPLE 1

A polyimide fiber composite thermally densified at 315° C., having a thickness of 0.50 mm and a density of 0.30 g/cm$^3$ as well as a strength of 15 N/mm$^2$ was adhered by means of a polyimide adhesive to a core produced by pultrusion of glass-reinforced polyester and having a width of 50 mm and a thickness of 4 mm.

The structure of the stacking support obtained is schematically illustrated in the FIGURE, the polyimide fiber composite being denoted by 1, the adhesive layer being denoted by 2 and the polyester core being denoted by 3.

EXAMPLE 2

A resin-impregnated glass cloth was combined with a polyimide fiber nonowoven on both sides by pultrusion and thermally bonded at a temperature of 100° C. The densified polyimide fiber composite had a thickness of 1 mm, a density of 0.30 g/cm$^3$ and a strength of 15 N/mm$^2$.

Glass mats or glass rovings might as well be used instead of a glass cloth as reinforcement in the matrix.

It has proved that thus produced stacking supports according to the invention having textile surface character are capable of being produced continuously. Depending on the starting materials chosen, stacking supports having moduli of elasticity of between 10,000 N/mm$^2$ and 40,000 N/mm$^2$ could be produced.

EXAMPLE 3

Glass-reinforced prepregs of phenolic, epoxy or polyester resins were pressed on both sides with a polyimide fiber composite thermally compacted at 315° C. and having a thickness of 1.0 mm and a density of 0.30 g/cm$^3$. In doing so, the composite structure was intended to reach a modulus of elasticity of $10\times10^3$ at $40\times10^3$ N/mm$^2$ with a multidirectional or unidirectional arrangement of the glass fibers.

EXAMPLE 4

A round-needled polyimide fiber nonwoven having a weight per unit area of 350 g/m$^2$ and a thickness of 3.0 mm was drawn on a parallelepipedic self-supporting core of aluminum and subsequently exposed to a temperature of 350° C. for 30 minutes. The polyimide fiber composite shrunk onto the core adopting its shape.

Instead of the round-needled nonwoven, a sewn nonwoven could be processed. Furthermore, it was possible to produce a stacking support by using steel or glass as core materials.

What we claim is:

1. A high-temperature resistant stacking support comprising of a core and a high-temperature resistant fiber composite made of polyimide fibers of the general formula

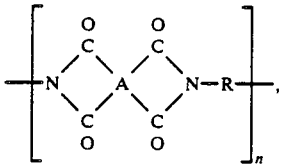

(I)

wherein n is an integer larger than 1 and A represents a four-valent aromatic group selected from

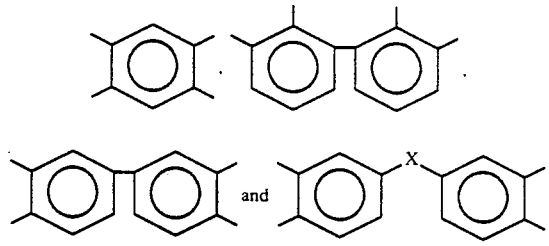

in which X is selected from the group consisting of CO, $CH_2$, O, S and $CF_2$, and R represents at least one of the following divalent aromatic groups selected from

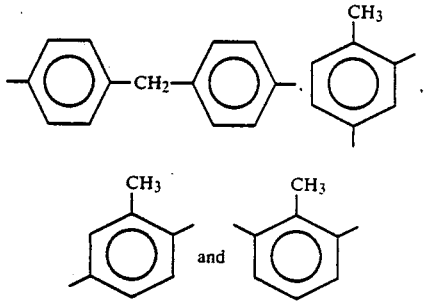

and at least partially surrounding said core.

2. A stacking support as set forth in claim 1, wherein said core is self-supporting.

3. A stacking support as set forth in claim 1, wherein said fiber composite exhibits the following properties in combination:

a thickness of 0.50 to 8.0 mm, a density of 0.3 to 1.1 g/cm$^3$;

a tensile strength of at least 15 N/mm$^2$.

4. A stacking support as set forth in claim 3, wherein said thickness is 1.0 to 3.0 mm.

5. A stacking support as set forth in claim 1, wherein said core is comprised of a fiber glass composite.

6. A stacking support as set forth in claim 5, wherein said fiber glass composite is a glass-reinforced synthetic resin.

7. A stacking support as set forth in claim 1, wherein said core is comprised of a metallic material.

8. A stacking support as set forth in claim 5 or 7, wherein said core has a modulus of elasticity ranging between 10,000 N/mm$^2$ and 40,000 N/mm$^2$.

9. A process for the production of a high-temperature resistant stacking support comprising a core and a high-temperature resistant nonwoven made of polyimide fibers of the general formula

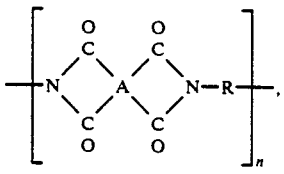

(I)

wherein n is an integer larger than 1 and A represents a four-valent aromatic group selected from

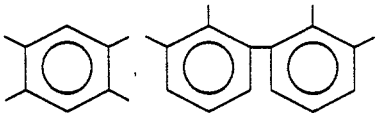
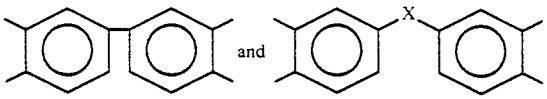
in which X is selected from the group consisting of CO, $CH_2$, O, S and $CF_2$, and R represents at least one of the following divalent aromatic groups selected from
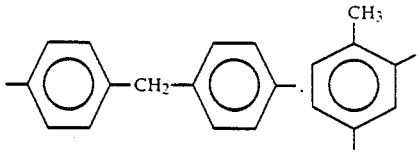
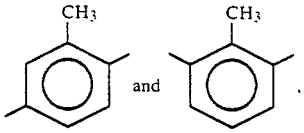
which process comprises shrinking said nonwoven onto said core under heat exposure.
* * * * *